US009291999B2

(12) United States Patent
Kaelin et al.

(10) Patent No.: US 9,291,999 B2
(45) Date of Patent: Mar. 22, 2016

(54) TIMEPIECE BARREL

(71) Applicant: ETA SA MANUFACTURE HORLOGÈRE SUISSE, Grenchen (CH)

(72) Inventors: Laurent Kaelin, Sonvilier (CH); Arthur Queval, Lutry (CH); Martin Vautherot, Publier (FR)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/653,484

(22) PCT Filed: Oct. 21, 2013

(86) PCT No.: PCT/EP2013/071989
§ 371 (c)(1),
(2) Date: Jun. 18, 2015

(87) PCT Pub. No.: WO2014/095126
PCT Pub. Date: Jun. 26, 2014

(65) Prior Publication Data

US 2015/0309475 A1 Oct. 29, 2015

(30) Foreign Application Priority Data

Dec. 18, 2012 (EP) ..... 12197746

(51) Int. Cl.
*G04B 1/18* (2006.01)
*G04B 1/16* (2006.01)
*G04B 1/14* (2006.01)

(52) U.S. Cl.
CPC ... *G04B 1/16* (2013.01); *G04B 1/14* (2013.01); *G04B 1/18* (2013.01)

(58) Field of Classification Search
CPC ..... G04B 1/16; G04B 1/14; G04B 1/18; G04B 1/165
USPC ..... 368/142
See application file for complete search history.

(56) References Cited

U.S. PATENT DOCUMENTS 161,236 A * 3/1875 Hunter ..... G04B 1/18 368/144
163,161 A * 5/1875 Dawson ..... G04B 1/18 368/144

(Continued)

FOREIGN PATENT DOCUMENTS

CH 15286 A 4/1898
CH 343891 A 12/1959

(Continued)

OTHER PUBLICATIONS

International Search Report issued May 6, 2014, in PCT/EP2013/071989, filed Oct. 21, 2013.

*Primary Examiner* — Sean Kayes
(74) *Attorney, Agent, or Firm* — Oblon, McClelland, Maier & Neustadt, L.L.P.

(57) ABSTRACT

A ratchet for winding a barrel, including an axial passage for fitting the ratchet onto an arbor carrying pivotal drive mechanism. The ratchet includes, in the axial passage, a strip spring permitting fitting of the ratchet onto the arbor, and exerting a bearing force on the pivotal drive mechanism, wherein the at least one strip spring forms a complementary drive for pivotally driving the arbor. A timepiece barrel for pivotal assembly between a bottom plate and a bridge includes a spring housed between a pivoting drum and a ratchet and hooked between, at an outer end thereof, the drum, and at an inner end thereof, an arbor, the arbor pivoting integrally with the ratchet about a pivot axis.

13 Claims, 2 Drawing Sheets

(56) References Cited

U.S. PATENT DOCUMENTS

| | | | | | |
|---|---|---|---|---|---|
| 174,031 | A | * | 2/1876 | Thornton | G04B 1/18<br>368/141 |
| 916,123 | A | * | 3/1909 | Duncanson | G04B 1/12<br>185/9 |
| 4,077,201 | A | | 3/1978 | Perrot | |

FOREIGN PATENT DOCUMENTS

| | | | |
|---|---|---|---|
| DE | 148352 | C | 5/1903 |
| FR | 1 034 443 | A | 7/1953 |
| FR | 1 443 494 | A | 6/1966 |
| FR | 2 135 134 | A1 | 12/1972 |
| FR | 2 329 000 | A1 | 5/1977 |
| GB | 647819 | A | 12/1950 |

* cited by examiner

TIMEPIECE BARREL

CROSS-REFERENCE TO RELATED APPLICATIONS

This is a National phase application in the United States of International patent application PCT/EP2013/071989 filed Oct. 21, 2013 which claims priority on European patent application 12197746.6 filed Dec. 18, 2012. The entire disclosure of each of which are hereby incorporated by reference.

FIELD OF THE INVENTION

The invention concerns an ratchet for winding a timepiece barrel, said ratchet including an axial passage for fitting the ratchet onto an arbor including protruding or recessed pivotal drive means.

The invention also concerns a timepiece barrel for pivotal assembly between a bottom plate and a bridge and including at least one spring housed between a pivoting drum and a cover and hooked between at the outer end thereof said drum, and at the inner end thereof an arbor, said arbor pivoting integrally with such a ratchet about a pivot axis.

The invention also concerns a timepiece movement including at least one bottom plate and a bridge and a barrel of this type.

The invention also concerns a watch including a movement of this type.

The invention concerns the field of timepiece mechanisms, and more specifically energy storage mechanisms, of the mainspring barrel, striking barrel or similar type.

BACKGROUND OF THE INVENTION

In order to increase the power reserve, by increasing the number of turns of a mainspring, secured at the inner end thereof to a core formed either by an arbor, which is generally cylindrical, or by a more solid boss, one solution consists in decreasing the diameter of the barrel arbor and of the associated boss, so as to increase the space available for the spring inside the drum.

The ratio of the core radius to the spring thickness is usually comprised between 10 and 20 and the invention proposes to reduce this ratio to below 10, and preferably to within a range of between 5 and 10.

The sizing must not be too small; there is a risk of breakage if the diameter of the core is too small.

In the conventional barrel architecture, a ratchet is axially mounted on a barrel arbor or on a core, via a square, with the ratchet usually being secured by an axial screw. The dimension of this screw and that of the square thus define the minimum diameter of a pivot shoulder. A step portion joined to this pivot shoulder limits the endshake of the arbor or of the core relative to a bottom plate or to a bridge carrying a jewel or similar element.

In particular, it is not sufficient merely to reduce all of the dimensions, since the cross-sections of material are then insufficient to ensure fatigue resistance.

The issue is thus to reconcile the smallest possible diameter, to allow the largest possible power reserve, with rigidity in the ratchet drive.

Thus, it is necessary to devise a barrel with a ratchet and arbor such that the smallest possible arbor diameter can pass the torque transmitted by the ratchet.

FR document No 2329000A1 in the name of ETA discloses a barrel with a non-cylindrical arbor having a drum element, the hook hooking the spring being contained in a recess delimited by a geometric cylinder defined by the upper and lower shoulders of the drum element.

XP document No 001219052A in the name of SOCIETE ODO discloses a barrel with a non-cylindrical arbor, carrying a tube which in turn carries the hook for hooking the spring. This arbor includes shoulders and grooves for circlips.

US document No 730103A in the name of ERICKSON discloses a non-cylindrical arbor including a faceted portion, called a rectangular portion, which carries a core bearing the hook for hooking the spring FR document No 2135134A1 in the name of BAUMGARTNER discloses a barrel with a slit sleeve carrying a barrel core.

CH document No 15286A in the name of DANASINO discloses a barrel with a spring whose cross-section gradually increases from the exterior to the interior of the drum.

FR document No 1443494A in the name of GLASHUETTER UHRENBETRIEB discloses a barrel with a cover plate which limits the axial travel of the barrel arbor.

FR document No 2210784A1 in the name of ETA discloses a single-piece arbor including a longitudinal groove for hooking the spring.

SUMMARY OF THE INVENTION

The invention proposes to improve the design of known barrels devised for a large power reserve by procuring a high level of rigidity, particularly as regards the ratchet, while maintaining a reduced number of components, and acceptable machining costs, or, preferably, more economical costs than for known barrels.

The invention therefore concerns a ratchet for winding a timepiece barrel, said ratchet including an axial passage for fitting the ratchet onto an arbor including protruding or recessed pivotal drive means, characterized in that said ratchet includes, in said axial passage, at least one strip spring permitting the fitting of said ratchet on said arbor and arranged to exert a bearing force on said pivotal drive means, wherein said at least one strip spring forms complementary drive means for pivotally driving said arbor.

The invention also concerns a timepiece barrel, for pivotal assembly between a bottom plate and a bridge and including at least one spring housed between a pivoting drum and a cover and hooked between, at the outer end thereof said drum, and at the inner end thereof an arbor which pivots integrally with such a ratchet about a pivot axis, characterized in that said arbor includes, about a cylindrical drum element along said pivot axis, on the one hand, a protruding hook for hooking said spring, and on the other hand, protruding or recessed pivotal drive means, which cooperate with complementary drive means comprised in said ratchet for the pivotal driving thereof.

According to a feature of the invention, said pivotal drive means form an axial stop member for said ratchet along said pivot axis, said arbor is pivoted at an upper shoulder in a bore of said bridge or of a jewel comprised in said bridge, and said ratchet includes an upper abutment fillet whose travel is limited by a lower surface of said bridge 5 or of said jewel, said ratchet being comprised between said bridge and an upper surface comprised in said drum opposite a lower surface of said ratchet, and said drum pivots in a bore comprised therein on said cylindrical drum element.

According to a feature of the invention in a particular variant, said spring includes, in the axial direction of said pivot axis, a protruding upper portion arranged to be supported on an inner surface of said drum, and a protruding lower portion arranged to be supported on an upper portion of said cover.

According to a feature of the invention, the endshake said drum is limited downwardly relative to said ratchet by an upper surface of said drum which is limited by a lower surface of said ratchet, the endshake of said ratchet is limited downwardly relative to said bridge, by a fillet of said ratchet which is limited by a lower surface of said bridge or of a jewel comprised in said bridge, and the endshake of said cover is limited upwardly relative to said bottom plate, by a lower surface of said cover which is limited by an upper surface of said bottom plate or of a jewel comprised in said bottom plate.

According to yet another feature of the invention, said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shearing modulus of between 80 and 100 GPa, said spring has a width to thickness ratio of between 3 and 23, and the ratio between the maximum radius of a spring bearing shoulder of said arbor and the thickness of said spring is between 3 and 9.

The invention also concerns a timepiece movement including at least one bottom plate and a bridge and a barrel of this type.

According to a feature of the invention in a particular variant said bridge includes an upper stop plate a lower surface of which is arranged to limit the axial travel of said arbor, and said bottom plate includes a lower stop plate whose upper surface is arranged to limit the axial travel of said arbor.

The invention also concerns a watch including a movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
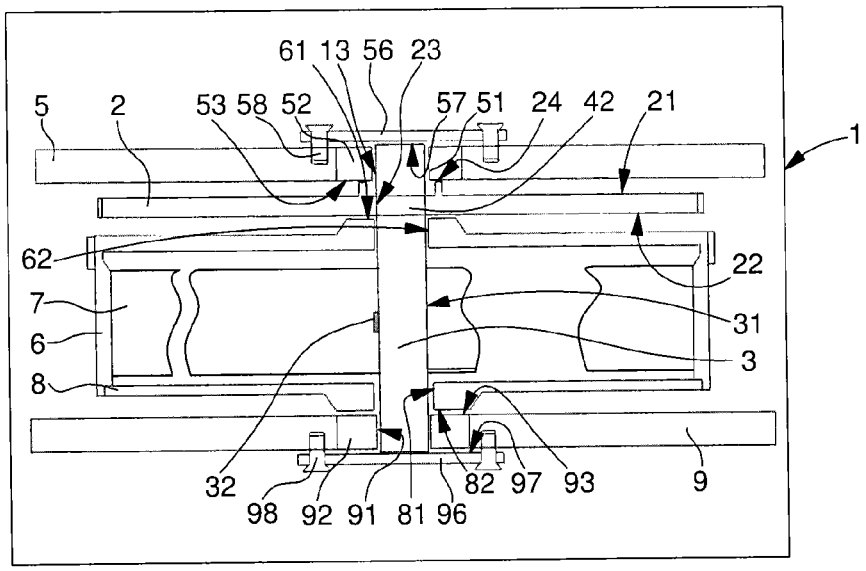
FIG. 1 shows a schematic cross-section of a barrel according to a first variant of the invention through the pivot axis thereof.

The invention concerns the field of timepiece mechanisms, and more specifically energy storage mechanisms, of the mainspring barrel, striking barrel or similar type.

The invention concerns a ratchet 2 for winding a timepiece barrel 1. This ratchet 2 includes an axial passage 20 for fitting the ratchet onto an arbor 3 including protruding or recessed pivotal drive means 42.

According to the invention, this ratchet 2 includes, in said axial passage 20, at least one strip spring 230 permitting the fitting of ratchet 2 onto arbor 3. This strip spring 230 is arranged to exert a bearing force on pivotal drive means 42 of arbor 3. This at least one strip spring 230 forms complementary drive means 23, which are complementary to said pivotal drive means 42 for pivotally driving arbor 3.

Figure 4:
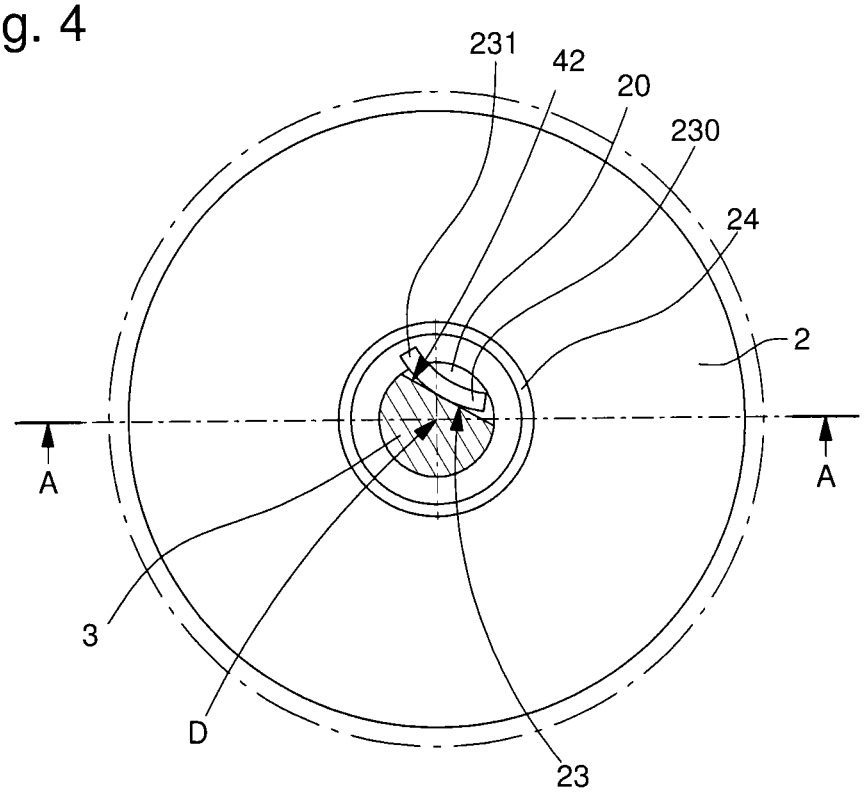
FIG. 4 shows a schematic top view of a ratchet according to the invention, equipped with a strip spring, which is shown in a position of cooperation with a flat drive portion comprised in an arbor (shown in cross-section in a median plane of the ratchet).
Figure 5:
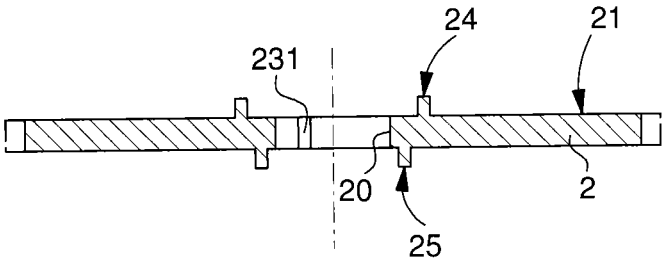
FIG. 5 shows a schematic cross-section in a plane A-A through the pivot axis of the ratchet of FIG. 4.

In a variant illustrated by FIGS. 4 and 5, ratchet 2 includes, for each said strip spring 230, a slot 231 opening into axial passage 20. It will be noted that a strip spring 230 of this type can be mounted projecting from the upper 21 and/or lower surfaces of ratchet 2.

Advantageously, ratchet 2 includes at least one upper abutment fillet 24 for limiting the travel of ratchet 2 relative to a bottom plate or to a bridge or to a jewel.

Advantageously, ratchet 2 includes, in immediate proximity to axial passage 20, at least one lower abutment fillet 25 for limiting the travel of ratchet 2 relative to a drum or to a barrel core.

The invention also concerns a timepiece barrel 1 for pivotal assembly between a bottom plate 9 and a bridge 5 and including at least one spring 7. This spring 7 is housed between a pivoting drum 6 and a cover 8 and is hooked between at the outer end thereof drum 6—and at the inner end thereof an arbor 3. Arbor 3 is mounted to pivot integrally with a ratchet 2 of this type about a pivot axis D.

According to the invention, arbor 3 includes, about a cylindrical drum element 31 along pivot axis D, on the one hand, a protruding hook 32 for hooking spring 7, and on the other hand, protruding or recessed pivotal drive means 42, which cooperate with complementary drive means 23 comprised in ratchet 2 for the pivotal driving thereof. Drive means 42 may consist, in a conventional manner, of a square or flat portions. FIG. 4 illustrates, for example, a simplified, non-limiting variant with an arbor 3 having a single flat portion 42. In a material efficient version, drive means 42 are recessed, for example formed by two flat portions in a groove of arbor 3, the complementary means 23 of ratchet 2 can then advantageously consist of at least one strip spring permitting the fitting of ratchet 2 on arbor 3 and also ensuring pivotal driving.

These pivotal drive means 42 form an axial stop member for ratchet 2 along pivot axis D. Arbor 3 is pivoted at an upper shoulder 13 in a bore 51 of bridge 5 or of a jewel 53 comprised in bridge 5. Ratchet 2 preferably includes, to reduce friction torque and loss of efficiency, at least one upper abutment fillet 24 whose travel is limited by a lower surface 53 of bridge 5 or of of jewel 52 (as shown in the Figures). Ratchet 2 is comprised between bridge 5 and an upper surface 61 comprised in drum 6 opposite a lower surface 22 of ratchet 2. Drum 6 pivots in a bore 62 comprised therein in cylindrical drum element 31.

Figure 2:
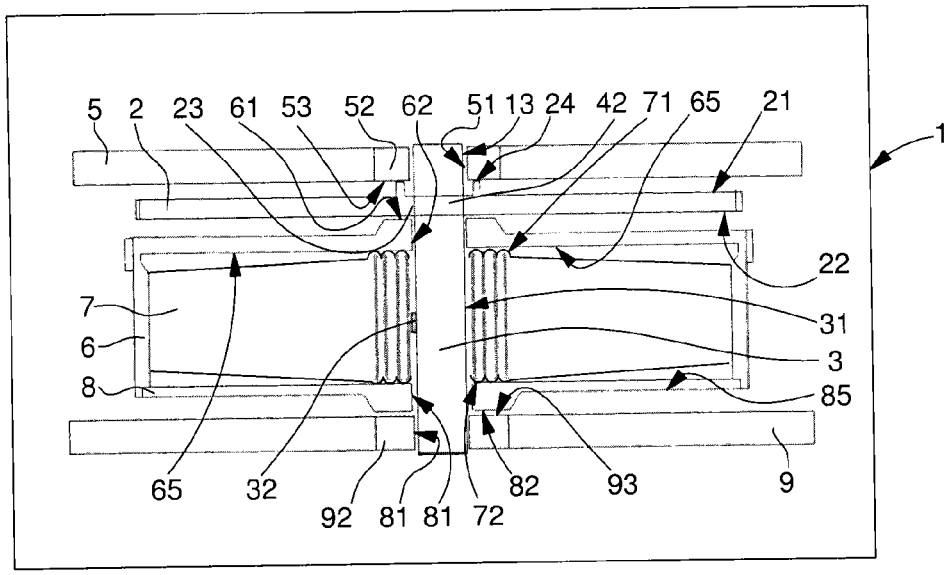
FIG. 2 shows a schematic cross-section of a barrel according to a second variant of the invention through the pivot axis thereof.
Figure 3:
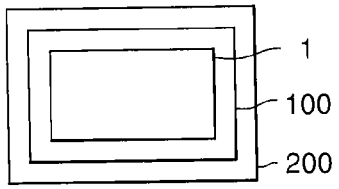
FIG. 3 shows a block diagram of a timepiece including a movement which includes a barrel according to the invention.

In the second variant of FIG. 2, spring 7 includes, in the axial direction of pivot axis D, a protruding upper portion 71 arranged to bear on an inner surface 65 of drum 6, and a protruding lower portion 72 arranged to bear on an upper portion 85 of cover 8. The endshake of arbor 3 is thus taken up by spring 7.

Drum 6 carries a cover 8, preferably but not necessarily pivotally integral with drum 6, and having a bore 81 which cooperates with a shoulder 31 of arbor 3. The travel of a lower surface 82 of cover 8 is limited by an upper surface 93 of bottom plate 9 or of a jewel 92 housed in bottom plate 9, a bore 91 of bottom plate 9 or of jewel 92 acting as a pivot for shoulder 31 of arbor 3.

The endshake of drum 6 is limited downwardly relative to ratchet 2, by an upper surface 61 of drum 6, which is limited by a lower surface 22 of ratchet 2. The endshake of ratchet 2 is limited downwardly relative to bridge 5, by an abutment fillet 24 of ratchet 2, which is limited by a lower surface 53 of bridge 5 or of a jewel 52 comprised in bridge 5. The endshake of cover 8 is limited upwardly relative to bottom plate 9 by a lower surface 82 of cover 8 which is limited by an upper surface 93 of bottom plate 9 or of a jewel 91 comprised in bottom plate 9

The mainspring may be made of various materials: carbon steel, stainless steel, "Nivaflex®", silicon, DLC, quartz, glass or similar. In a particular application, spring 7 is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa. This spring 7 preferably has a width to thickness ratio comprised between 3 and 23, and more particularly between 9 and 21.

Also, the maximum radius of shoulder 31 of arbor 3 (not taking account of any excess thickness of a hook 32), made of steel or stainless steel, for example of 4C27A hardenable steel (also called according to the various standards 1.4197, ASTM 420F, or DIN X22 CrMoNiS 13 1), relative to pivot axis D is less than nine times the maximum thickness of spring 7. In particular, with the illustrated embodiments it is possible to obtain a ratio of the maximum radius of shoulder 31 of arbor 3 to the thickness of spring 7 of between 3 and 9, and preferably between 4 and 6, preferably close to five.

The invention also concerns a timepiece movement 100 including at least one bottom plate 9 and a bridge 5 and a barrel 1 of this type. Bridge 5 may include at least one net, intended to cooperate in abutment with the least possible contact surface, with upper surface 21 of ratchet 2 in addition to or instead of abutment fillet 24 of ratchet 2.

In the first variant of FIG. 1, bridge 5 includes an upper stop plate 56 secured with screws or rivets 58 or adhesive bonded or welded, or suchlike, a lower surface 57 of which is arranged to limit the axial travel of arbor 3, and bottom plate 9 includes a lower stop plate 96 secured with screws or rivets 98 or adhesive bonded or welded, or suchlike, an upper surface 97 of which is arranged to limit the axial travel of arbor 3.

The invention also concerns a watch 200 including a movement 100 of this type.

In short, the first variant of FIG. 1, is advantageous as arbor 3 is of substantially constant diameter, and hook 32 is easy to machine, as are drive means 42. The core diameter is limited only by the size of pivotal drive means 42.

In the second variant of FIG. 2 the endshake of arbor 3 is taken up by spring 7, arbor 3 adopts the same advantageous low cost configuration as in the first variant. The core diameter is limited by the dimensions of drive means 42, typically a square or similar.

The invention claimed is:

1. A timepiece arbor-ratchet assembly, comprising:

an arbor and a ratchet for winding a timepiece barrel, the ratchet including an axial passage for fitting the ratchet onto the arbor including a protruding or recessed pivotal drive means, wherein the ratchet includes, in the axial passage, at least one strip spring permitting fitting of the ratchet on the arbor and arranged to exert a bearing force on the pivotal drive means, wherein the at least one strip spring forms complementary drive means for pivotally driving the arbor.

2. An arbor-ratchet assembly according to claim 1, wherein the ratchet includes, for each strip spring, a slot opening into the axial passage.

3. An arbor-ratchet assembly according to claim 1, wherein the ratchet includes at least one upper abutment fillet for limiting travel of the ratchet relative to a bottom plate or to a bridge or to a jewel.

4. An arbor-ratchet assembly according to claim 1, wherein the ratchet includes, in immediate proximity to the axial passage, at least one lower abutment fillet for limiting travel of the ratchet relative to a drum or to a barrel core.

5. A timepiece barrel comprising:

an arbor-ratchet assembly according to claim 1, for pivotal assembly between a bottom plate and a bridge and including at least one spring, housed between a pivoting drum and a cover, and the spring being hooked between, at an outer end thereof, the drum, and at an inner end thereof, the arbor of the arbor-ratchet assembly, the arbor pivoting integrally about a pivot axis with the ratchet of the arbor-ratchet assembly, wherein the arbor includes, about a cylindrical drum element, along the pivot axis, a protruding hook for hooking the spring, and a protruding or recessed pivotal drive means, which cooperate with the complementary drive means in the ratchet for pivotal driving thereof.

6. A barrel according to claim 5, wherein the pivotal drive means forms an axial stop member for the ratchet along the pivot axis, wherein the arbor is pivoted on an upper shoulder in a bore of the bridge or of a jewel in the bridge, wherein the ratchet includes an upper abutment fillet whose travel is limited by a lower surface of the bridge or of the jewel, the ratchet being arranged between the bridge and an upper surface of the drum opposite a lower surface of the ratchet, and wherein the drum pivots in a bore therein in the cylindrical drum element.

7. A barrel according to claim 5, wherein the spring includes, in the axial direction of the pivot axis, a protruding upper portion arranged to bear on an inner surface of the drum, and a lower protruding surface arranged to bear on an upper portion of the cover.

8. A barrel according to claim 5, wherein the drum carries a cover that pivots integrally with the drum, and a bore of which cooperates with the cylindrical drum element of the arbor, and wherein travel of a lower surface of the cover is limited by an upper surface of the bottom plate or of a jewel housed in the bottom plate, a bore of the bottom plate or of the jewel acting as pivot for the cylindrical drum element of the arbor.

9. A barrel according to claim 5, wherein an endshake of the drum is limited downwardly relative to the ratchet by an upper surface of the drum which is limited by a lower surface of the ratchet, wherein an endshake of the ratchet is limited downwardly relative to the bridge by a fillet of the ratchet which is limited by a lower surface of the bridge or of a jewel in the bridge, and wherein an endshake of the cover is limited upwardly relative to the bottom plate by a lower surface of the cover which is limited by an upper surface of the bottom plate or of a jewel in the bottom plate.

10. A barrel according to claim 5, wherein the spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, wherein the spring has a width to thickness ratio of between 3 and 23, and wherein the ratio between the maximum radius of a spring bearing shoulder of the arbor and thickness of the spring is between 3 and 9.

11. A timepiece movement comprising at least one bottom plate and a bridge and a barrel according to claim 5.

12. A movement according to claim 11, wherein the bridge includes an upper stop plate of which a lower surface is arranged to limit axial travel of the arbor, and wherein the bottom plate includes a lower stop plate of which an upper surface is arranged to limit axial travel of the arbor.

13. A watch comprising a movement according to claim 11.

* * * * *